US008011343B2

(12) United States Patent
Kobayashi et al.

(10) Patent No.: US 8,011,343 B2
(45) Date of Patent: Sep. 6, 2011

(54) MULTI LINK TYPE PISTON-CRANK MECHANISM OF INTERNAL COMBUSTION ENGINE

(75) Inventors: Makoto Kobayashi, Fujisawa (JP); Kenshi Ushijima, Kamakura (JP); Hideaki Mizuno, Yokohama (JP); Naoki Takahashi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 616 days.

(21) Appl. No.: 12/183,583

(22) Filed: Jul. 31, 2008

(65) Prior Publication Data

US 2009/0031994 A1 Feb. 5, 2009

(30) Foreign Application Priority Data

Aug. 3, 2007 (JP) ..... 2007-202520

(51) Int. Cl.
*F02B 75/04* (2006.01)

(52) U.S. Cl. ..... 123/197.4; 123/48 B; 123/78 F

(58) Field of Classification Search ..... 123/48 R, 123/48 B, 78 R, 78 F, 197.1, 197.4
See application file for complete search history.

(56) References Cited

U.S. PATENT DOCUMENTS 6,792,924 B2 9/2004 Aoyama et al.

FOREIGN PATENT DOCUMENTS

| | | | |
|---|---|---|---|
| JP | 2002 061501 | A | 2/2002 |
| JP | 2003-232233 | A | 8/2003 |
| JP | 2004-162895 | A | 6/2004 |

*Primary Examiner* — Noah Kamen
(74) *Attorney, Agent, or Firm* — Foley & Lardner LLP

(57) ABSTRACT

A multi link type piston-crank mechanism comprises an upper link that has one end pivotally connected to a piston of the engine through a piston pin, a lower link that is pivotally connected to the other end of the upper link through an upper pin and rotatably disposed on a crank pin of a crankshaft of the engine; and a control link that has a base end part swingably held by a body of the engine and a leading end pivotally connected to the lower link through a control pin. An axis of the piston pin is offset relative to an axis of the piston in thrust and counter thrust directions. When the piston comes to BDC, a part of the piston takes a position below a lower edge of a corresponding cylinder of the engine and the upper pin is offset relative to the axis of the piston pin in the same direction as a pin offset direction in which the axis of the piston pin is offset in the thrust and counter thrust directions relative to the axis of the piston.

9 Claims, 4 Drawing Sheets

MULTI LINK TYPE PISTON-CRANK MECHANISM OF INTERNAL COMBUSTION ENGINE

BACKGROUND OF THE INVENTION

1. Field of the Invention

The present invention relates to a multi link type piston-crank mechanism of an internal combustion engine, in which each piston of the engine and an associated crankpin of a crankshaft are connected through a plurality of links.

2. Description of the Related Art

For ease of understanding the present invention, one multi link type piston-crank mechanism hitherto proposed by the same applicants will be briefly described in the following, which is disclosed in Japanese Laid-open Patent Application (Tokkai) 2004-162895.

In the multi link type piston-crank mechanism disclosed in the publication, a lower link rotatably disposed on a crankpin of a crankshaft is connected to a corresponding piston through an upper link, and a control link is pivotally connected to the lower link to control movement of the lower link.

It has been revealed that the multi link type piston-crank mechanism of the above-mentioned publication exhibits a high freedom in setting piston stroke characteristic as compared with a single link type piston-crank mechanism in which a piston and a corresponding crank pin are connected through a single connecting rod or link. That is, in case of the multi link type, by bringing the piston stroke characteristic close to that of a simple harmonic motion (viz., sine wave), it becomes possible to reduce a vibration of the engine effectively. Furthermore, in the multi link type, by changing the position of a pivot end of the control link that is pivotally connected to a body of the engine, a compression ratio of the engine can be continuously varied while changing respective positions of TDC (viz., top dead center) and BDC (viz., bottom dead center) of the piston. That is, so-called "variable compression ratio mechanism" is readily made by such multi link type.

SUMMARY OF THE INVENTION

However, in internal combustion engines of a type having the above-mentioned variable compression ratio mechanism, increase in piston stroke for achieving a higher compression ratio and/or increase in displacement inevitably brings about increase in height of each cylinder and thus dimensional enlargement or bulky construction of the engine.

In order to minimize the degree of the dimensional enlargement of the engine, that would be caused by such increased piston stroke, measures have been proposed by the same applicants. That is, in the measures, when the piston is at the BDC (viz., bottom dead center), a skirt portion of the piston takes a position lower than a lower edge of the corresponding cylinder.

However, in the above-mentioned measures, hard contact of the skirt portion of the piston with the lower edge of the cylinder inevitably occurs during operation of the engine, which induces a possibility of damaging the skirt portion of the piston. That is, when the engine is controlled to take a lower compression ratio side, lowering the position of TDC induces lowering of the position of BDC. Furthermore, usually, for avoiding undesired engine knocking, the engine under high speed operation is controlled to run in the lower compression ratio side, and thus, both an inertial force of piston produced in the vicinity of BDC and a thrust load in thrust and counter thrust directions (viz., a thrust load applied from cylinder to piston) become marked. Thus, even if the above-mentioned measures are practically employed, it is difficult to completely eliminate the fear of damaging the skirt portion of the piston.

It is therefore an object of the present invention to provide a multi link type piston-crank mechanism of an internal combustion engine, which is free of the above-mentioned drawbacks.

That is, according to the present invention, there is provided a multi link type piston-crank mechanism of an internal combustion engine, by which the undesired hard contact of the piston with the lower edge of the cylinder is avoided while avoiding or at least minimizing increase in height of cylinders which would be caused by increase of piston stroke.

That is, in the present invention, there is provided a multi link type piston-crank mechanism of an internal combustion engine, which comprises an upper link that has one end pivotally connected to a piston of the engine through a piston pin, a lower link that is pivotally connected to the other end of the upper link through an upper pin and pivotally mounted on a crank pin of a crankshaft of the engine, and a control link that has a base end swingably held by a body of the engine and the other end pivotally connected to the lower link through a control pin, wherein an axis of the piston pin (viz., piston pin axis) is offset in the thrust and counter thrust directions relative to an axis of the piston (viz., piston axis), wherein when the piston comes to BDC, a part of the piston takes a position below a lower edge of a cylinder of the engine and the upper pin is offset relative to the axis of piston pin in the same direction as a pin offset direction in which the piston pin axis is offset in the thrust and counter thrust directions relative to the piston axis.

In accordance with a first aspect of the present invention, there is provided a multi link type piston-crank mechanism of an internal combustion engine, which comprises an upper link that has one end pivotally connected to a piston of the engine through a piston pin; a lower link that is pivotally connected to the other end of the upper link through an upper pin and rotatably disposed on a crank pin of a crankshaft of the engine; and a control link that has a base end part swingably held by a body of the engine and a leading end pivotally connected to the lower link through a control pin, wherein an axis of the piston pin is offset relative to an axis of the piston in thrust and counter thrust directions, and wherein when the piston comes to BDC (viz., bottom dead center), a part of the piston takes a position below a lower edge of a corresponding cylinder of the engine and the upper pin is offset relative to the axis of the piston pin in the same direction as a pin offset direction in which the axis of the piston pin is offset in the thrust and counter thrust directions relative to the axis of the piston.

In accordance with a second aspect of the present invention, there is provided a multi link type piston-crank mechanism of an internal combustion engine, which comprises an upper link that has one end pivotally connected to a piston of the engine through a piston pin; a lower link that is pivotally connected to the other end of the upper link through an upper pin and rotatably disposed on a crank pin of a crankshaft of the engine; a control link that has a base end part swingably held by a body of the engine and a leading end pivotally connected to the lower link through a control pin; means for establishing that an axis of the piston pin is offset relative to an axis of the piston in thrust and counter thrust directions; and means for establishing that when the piston comes to BDC (viz., bottom dead center), a part of the piston takes a position below a lower edge of a corresponding cylinder of the engine and the upper pin is offset relative to the axis of the piston pin in the same direction as a pin offset direction in which the axis of the piston pin is offset in the thrust and counter thrust directions relative to the axis of the piston.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an embodiment of the present invention, that is a multi link type piston-crank mechanism, will be described in detail with reference to the accompanying drawings.

For ease of understanding, various directional terms, such as right, left, upper, lower, rightward and the like are used in the following description. However, such terms are to be understood with respect to only a drawing or drawings on which a corresponding part or portion is shown.

Furthermore, some of the drawings of FIGS. 1 to 6 are illustrated with exaggeration and thus, actual shape and dimension are not exactly reflected from such drawings.

Figure 1:
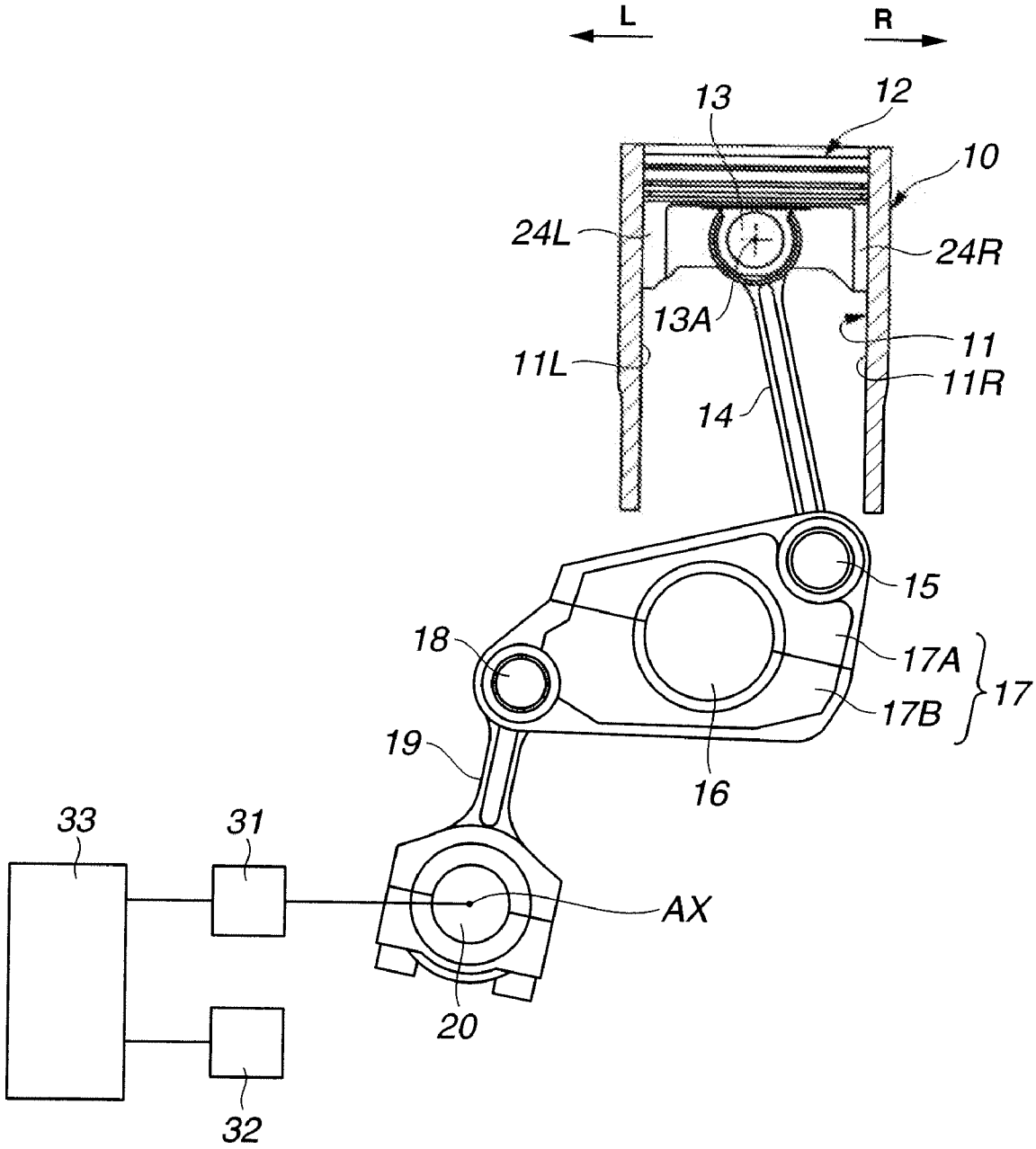
FIG. 1 is a schematic diagram of a multi link type piston-crank mechanism of an internal combustion engine, which is an embodiment of the present invention.

Referring to FIG. 1 of the drawings, there is schematically shown a multi link type piston-crank mechanism of an internal combustion engine, which an embodiment of the present invention.

In FIG. 1, denoted by numeral 10 is a cylinder block of an internal combustion engine to which the multi link type piston-crank mechanism of the invention is practically applied.

As shown, cylinder block 10 has a plurality of cylinders 11 (only one is shown) each having a piston 12 slidably and reciprocatively received therein. Piston 12 has a piston pin 13 connected thereto. As will be described in detail hereinafter, an axis of piston pin 13 is perpendicular to an axis of piston 12.

The multi link type piston-crank mechanism of the invention comprises an upper link 14 that has an upper end pivotally connected to piston pin 13 of piston 12. A lower end of upper link 14 is pivotally connected through an upper pin 15 to a right upper end of a lower link 17 that is rotatably disposed on a crank pin 16 of a crankshaft of the engine. A left lower end of lower link 17 is pivotally connected through a control pin 18 to an upper end of a control link 19 that has a lower base part swingably held by a given portion of cylinder block 10. As shown, lower link 17 comprises two parts 17A and 17B that are detachably coupled. This detachably coupling is effective for easily mounting lower link 17 on crank pin 16.

As shown, the lower base part of control link 19 is swigably disposed on an eccentric cam portion 20 of a control shaft that is rotatably held by cylinder block 10.

An axis "AX" of eccentric cam portion 20 is eccentric to an axis (not shown) of the control shaft, so that when the control shaft is rotated about its axis by an actuator 31 in accordance with an operation condition of the engine, an angular position of eccentric cam portion 20 (viz., the position of fulcrum of control link 19) is continuously changed. Due to this change, the movement of lower link 17 controlled by control link 19 is changed thereby to change positions of TDC and BDC of piston 12 changing a compression ratio of the engine (viz., engine compression ratio).

As will become apparent as the description proceeds, the control shaft and actuator 31 constitute a so-called variable compression ratio means that forces the above-mentioned multi link type piston-crank mechanism to work as a variable compression ratio mechanism.

In the multi link type piston-crank mechanism used for the variable compression ratio mechanism, the engine compression ratio can be varied in accordance with an operation condition of the engine. Furthermore, the multi link type is superior to the single link type as to a freedom of setting piston stroke characteristic. Actually, by suitably setting a dimension of the links, it is possible to make the piston stroke characteristic close to the characteristic of a simple harmonic motion as compared with the single link type and at the same time it is possible to make an inclination angle of upper link 14 (viz., the angle relative to a traveling path of piston 12) in a piston move-down process smaller than that in a piston move-up process. With such attainment, a piston inertia force produced in the vicinity of TDC can be remarkably reduced, and a thrust load in thrust and counter thrust directions (viz., a thrust load applied from the cylinder to the piston) in the piston move-down process in the vicinity of TDC wherein a marked load is applied to the piston due to explosion can be reduced. Particularly, with the piston stroke characteristic being close to that of the simple harmonic motion, the dwell time of piston in the vicinity of BDC is shortened and thus acceleration of piston is increased while increasing the inertia force of piston. Accordingly, an after-mentioned time range in which an in-cylinder pressure (viz., the pressure in cylinder) is kept higher than the inertia force is reduced, so that the undesired contact of the piston with the lower edge of cylinder is avoided or at least minimized.

When the engine is set at a lower compression ratio, the position of TDC is lower than that established when the engine is set at a higher compression ratio, and the position of BDC inevitably lowers. In such condition, as will be understood from FIG. 2, the degree by which piston 12 is projected downward from a lower edge 26 of cylinder 11 increases, which tends to induce the undesired contact of piston 12 with the lower edge of cylinder 11.

Accordingly, in the present invention, when the engine is set at such a lower compression ratio, the inclination angle of upper link 14 (viz., the angle relative to the traveling path of piston 12) is set smaller than a value set when the engine is set at a higher compression ratio. With this setting, the thrust load originating from the inclination of upper link 14 can be made small, and thus, even if the undesired contact of piston 12 with the lower edge 26 takes place, the influence of such contact to piston 12 can be reduced or least minimized.

Furthermore, as is seen from FIG. 1, in the internal combustion engine having the above-mentioned multi link type piston-crank mechanism, there is employed a variable valve lift mechanism 32 that continuously varies the valve lift characteristic of each intake valve. The valve lift characteristic is represented by an operation angle and lift degree of the valve. The detail of such variable valve lift mechanism 32 is described in Japanese Laid-open Patent Application (Tokkai) 2003-232233 and thus description of the mechanism 32 will be omitted.

Variable valve lift mechanism 32 and the above-mentioned actuator 31 are controlled by a control unit 33. By processing information signals issued from various sensors (not shown), control unit 33 computes an operation condition of the engine and issues appropriate instruction signals to mechanism 32 and actuator 31 in accordance with the engine operation condition computed.

Figure 2:
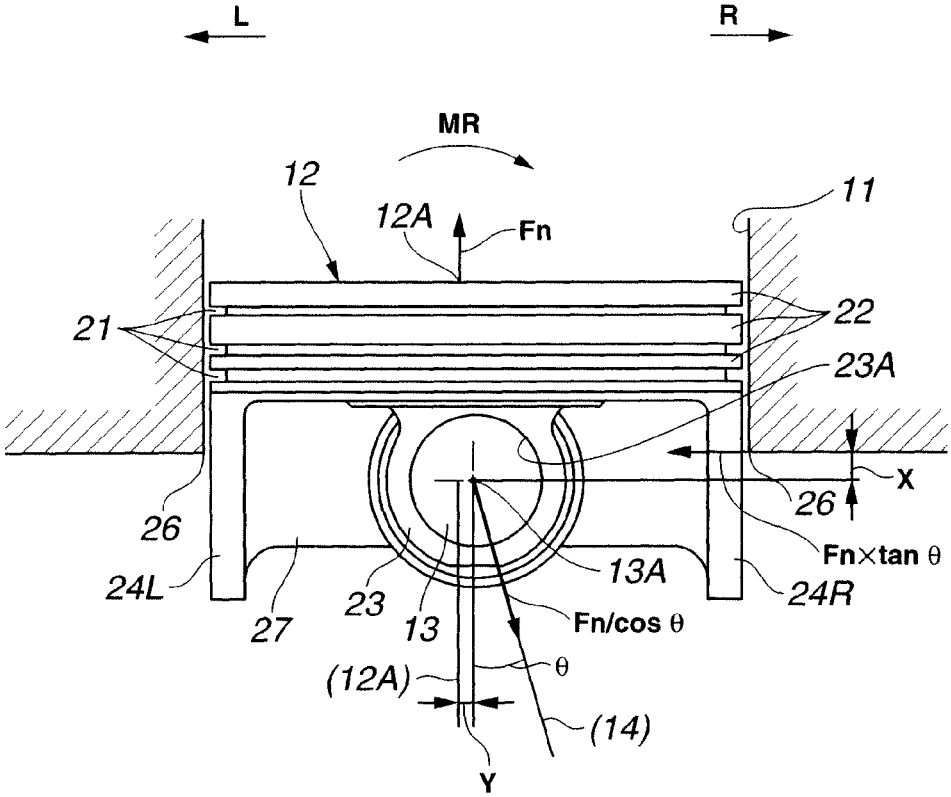
FIG. 2 is an illustration showing a degree of offset possessed by a piston pin in a condition wherein a piston is at BDC (viz., bottom dead center)

Piston 12 is made of, for example, aluminum die-cast and as will be seen from FIG. 2, has at a cylindrical crown portion thereof a plurality of ring grooves 21 (three in the illustrated example) that receive piston rings (not shown). Due to provision of such ring grooves 21, land portions 22 are left on the cylindrical crown portion of piston 12, as shown. That is, ring grooves 21 and land portions 22 are alternately provided on the crown portion of piston 12.

Aligned piston pin bosses 23 are provided on a lower portion of piston 12 and have respective pin holes 23A with which a piston pin 13 is engaged. Each piston pin boss 23 is in the shape of a cylinder. A ring-shaped upper end of the above-mentioned upper link 14 is put between piston pin bosses 23 while pivotally receiving piston pin 13.

In FIG. 2, designated by numeral 13A is an axis (or center axis) of piston pin 13. In other words, the axis 13A is a piston pin axis that passes through respective centers of piston pin bosses 23.

As shown, two, viz., right and left skirt portions 24R and 24L project downward from diametrically opposed portions of the cylindrical crown portion of piston 12 respectively.

It is to be noted that an imaginary axis that passes through respective center points of the diametrically opposed portions of the cylindrical crown portion of piston 12 extends perpendicular to an after-mentioned piston axis 12A of piston 12. For ease of understanding and description, the direction in which the imaginary axis extends will be referred to as "thrust and counter thrust directions" hereinafter.

Furthermore, as is seen from FIG. 2, between right and left skirt portions 24R and 24L, there extend rounded apron portions 27 (viz., apron portions on this side and the other side) that are integral with the skirt portions 24R and 24L. Thus, the cylindrical crown portion, the right and left skirt portions 24R and 24L and the rounded apron portions constitute a cylindrically shaped body, that is, the piston 12.

In FIG. 2, designated by numeral 12A is an axis (or center axis) of piston 12, that is, an axis that passes through a center of the crown portion of piston 12. For ease of understanding, this axis 12A will be referred to as "piston axis" hereinafter.

As is seen from this drawing, the above-mentioned piston pin axis 13A is offset by a distance of "Y" in the thrust and counter thrust directions with respect to the piston axis 12A.

For ease of understanding, in the following description, the side or direction (viz., right side in FIGS. 1 to 6) toward which the piston pin axis 13A is offset or projects from the piston axis 12A will be called "pin offset side-R" or "pin offset direction-R", and the other side or direction (viz., left side in FIGS. 1 to 6) will be called "counter pin offset side-L" or "counter pin offset direction-L".

Furthermore, in the following description, parts or portions in the "pin offset side-R" will be indicated by the addition of letter "R" after each numeral, while those in the "counter pin offset side-L" will be indicated by the addition of letter "L" after each corresponding numeral.

In the present invention, the following arrangement is established. As is mentioned hereinabove and seen from FIG. 1, the lower end of upper link 14 is pivotally connected to lower link 17 through upper pin 15.

Figure 3:
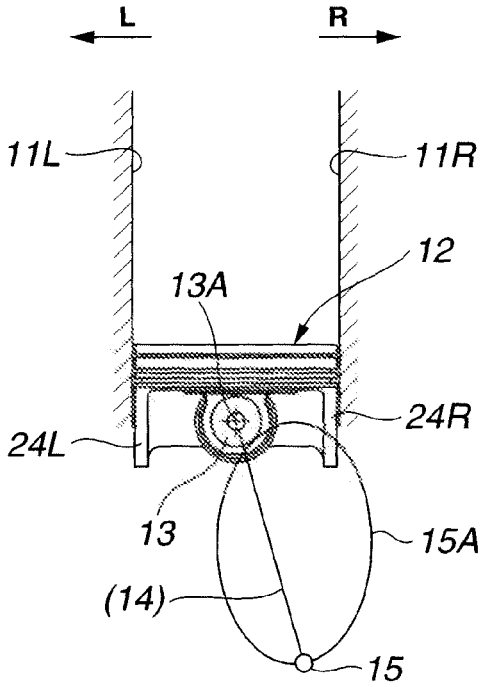
FIG. 3 is a schematic view of the multi link type piston-crank mechanism of the embodiment in a condition wherein the piston is at BDC.

That is, as will be seen from FIGS. 2 and 3, in the invention, the locus or traveling path of upper pin 15 (viz., the piston stroke characteristic) is so set that throughout almost reciprocating movement of piston 12 that includes movement in the vicinity of BDC and TDC, upper pin 15 keeps the offset of "pin offset side-R". In other words, during the reciprocating movement of piston 12 between BDC and TDC, upper link 14 keeps an inclination state with its upper portion inclined toward "counter pin offset side-L".

With the above-mentioned arrangement, movement of piston 12 in the thrust and counter thrust directions is restricted, and thus undesired contact of piston 12 with the inner wall of cylinder 11, which would be caused by such movement, is suppressed or at least minimized.

In order to avoid excessive inclination of upper link 14, the setting is so made that the inclination direction (viz., direction of inclination) of upper link 14 is reversed in the vicinity of TDC at a crank angle smaller than 40 degrees.

As is seen from FIGS. 2 to 4, the piston stroke characteristic is so made that when piston 12 comes to the position of BDC or near BDC, at least a part of the skirt portions 24R and 24L takes position below a lower edge 26 of cylinder 11. More specifically, as is seen from FIG. 2, when piston 12 comes to BDC, the lower edge 26 of cylinder 11 positioned above the piston pin axis 13A. With such measure, undesired increase in height of cylinder 11, which would be caused an enlargement of the piston stroke, can be suppressed or at least minimized.

When piston 12 is at or in the vicinity of BDC, upward force (or lifting torque) is applied to the crown portion of piston 12 due to work of an in-cylinder negative pressure, and at the same time, a downward inertia force is applied to the crown portion.

Thus, when the in-cylinder negative pressure is small and thus the downward inertial force is marked, piston 12 is pressed against the cylinder wall 11L of "counter pin offset side-L", and at the same time, due to the offset positioning of piston pin axis 13A, a turning moment in the "counter pin offset direction-L" (viz., in a counterclockwise direction in the drawing) is applied to piston 12, so that an upper portion of piston 12 at the "counter pin offset side-L" is strongly pressed against the cylinder wall 11L.

Figure 4:
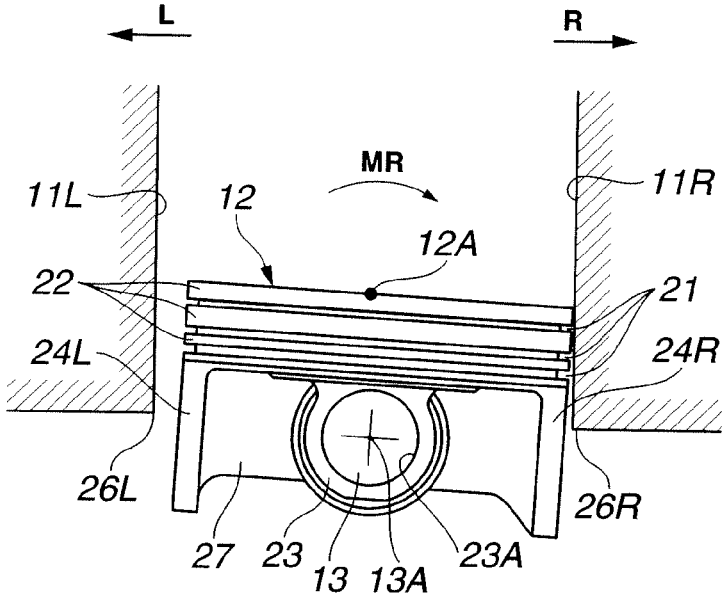
FIG. 4 is a view similar to FIG. 2, but showing a condition wherein the piston is at BDC while being inclined in the direction of "MR"

When the upward force due to the in-cylinder negative pressure is superior to the downward inertia force and thus the upward force becomes marked, piston 12 is pressed against the cylinder wall 11R of the "pin offset side-R" due to inclination of upper link 14, and at the same time, a turning moment "MR" in the direction of "pin offset side-MR" around the piston pin axis 13A (viz., in a clockwise direction in FIGS. 2 and 4) due to the offset positioning of the piston pin axis 13A is applied to piston 12, so that as is exaggeratingly shown in FIG. 4, at the "pin offset side-R", the upper portion of piston 12 is strongly pressed against the cylinder wall 11R as compared with a lower portion of piston 12, so that a lower portion of piston 12 is moved away from the lower edge 26 of cylinder 11. Thus, when piston 12 is at or in the vicinity of BDC, piston 12 is forced to take such a posture as to receive a thrust load at an upper portion of piston 12, that is, the posture in which a lower portion of piston 12 is separated from cylinder 11, so that undesired contact between the skirt portion 24R (viz., the lower portion of piston 12) and the lower edge 26R of cylinder 11 is suppressed or at least minimized.

In order to much clearly explain the present invention, the features of the present invention will be described with reference to FIG. 2.

In FIG. 2, the amount of offset of piston pin axis 13A relative to piston axis 12A in the thrust and counter thrust directions is denoted by "Y", an inclination angle of upper link 14 relative to the cylinder axis (or reciprocating axis of piston pin) at the time when the piston 12 takes BDC is denoted by "θ", and a distance from the piston pin axis 13A to the lower edge 26 of cylinder 11 in the direction of the cylinder axis at the time when piston 12 is at BDC is denoted by "X". Thus, the value "X" may be called "piston exposed degree".

When, due to work of the in-cylinder negative pressure, an upward force "Fn" is applied to the piston axis 12A, a downward force "Fn/cos θ" is applied, as a reaction, to the piston axis 12A along a direction (viz., inclined direction) in which upper link 14 extends, and at the same time, a thrust load of "Fn×tan θ" is applied to the piston axis 12A from the cylinder wall 11R of the "pin offset side-R".

Accordingly, in an engine that is so set as to place the piston pin axis 13A below the lower edge 26 of cylinder 11 at the time when piston 12 takes BDC, the following advantageous phenomena are expected.

That is, if a lower portion of piston 12 is forced to contact with the lower edge 26 of cylinder 11 thereby receiving a thrust load of "Fn×tan θ", a turning moment of "Fn×Y" originating from the above-mentioned upward force "Fn" is applied to piston 12 in the "pin offset direction-R" (viz., in a clockwise direction in FIG. 2) and at the same time a turning moment of "Fn×tan θ×X" originating from the above-mentioned thrust load is applied to piston 12 in the "counter pin offset direction-L" (viz., in a counterclockwise direction).

In the invention, the following inequality is established.

$$Y \geqq X \cdot \tan\theta \quad (1)$$

That is, when the engine is constructed to satisfy the above-mentioned inequality (1), damages of piston 12, that would be caused by the above-mentioned contact between piston 12 and lower edge 26 of cylinder 11, are suppressed or at least minimized. That is, due to the engine construction satisfying the inequality (1), the turning moment of "Fn×Y" in the "pin offset direction-MR" originating from the in-cylinder negative pressure constantly shows a value that is larger than the turning moment of "Fn×tan θ×X" in the "counter pin offset direction" originating from the thrust load. This prevents scuffing of piston 12.

As is described hereinabove, ailments of piston 12, which would be caused by the in-cylinder negative pressure, are suppressed or at least minimized in the present invention. Thus, various restrictions that have been needed for eliminating the ailments are eased, and thus, the freedom of setting the variable valve lift mechanism 32 is high according to the present invention. That is, according to the present invention, it is possible to set an engine in a manner to produce a high in-cylinder negative pressure that is needed in a small lift condition, and thus, by suitably controlling the valve lift characteristic of the intake valves in accordance with an operation condition of the engine, fuel consumption and exhaust performance (viz., purification of exhaust gas) are improved.

Figure 5:
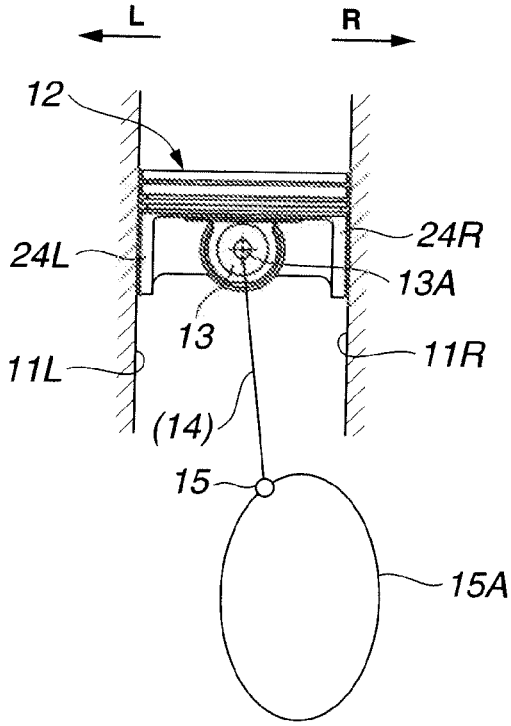
FIG. 5 is a view similar to FIG. 3, but showing a condition wherein the piston is at TDC (viz., top dead center)
Figure 6:
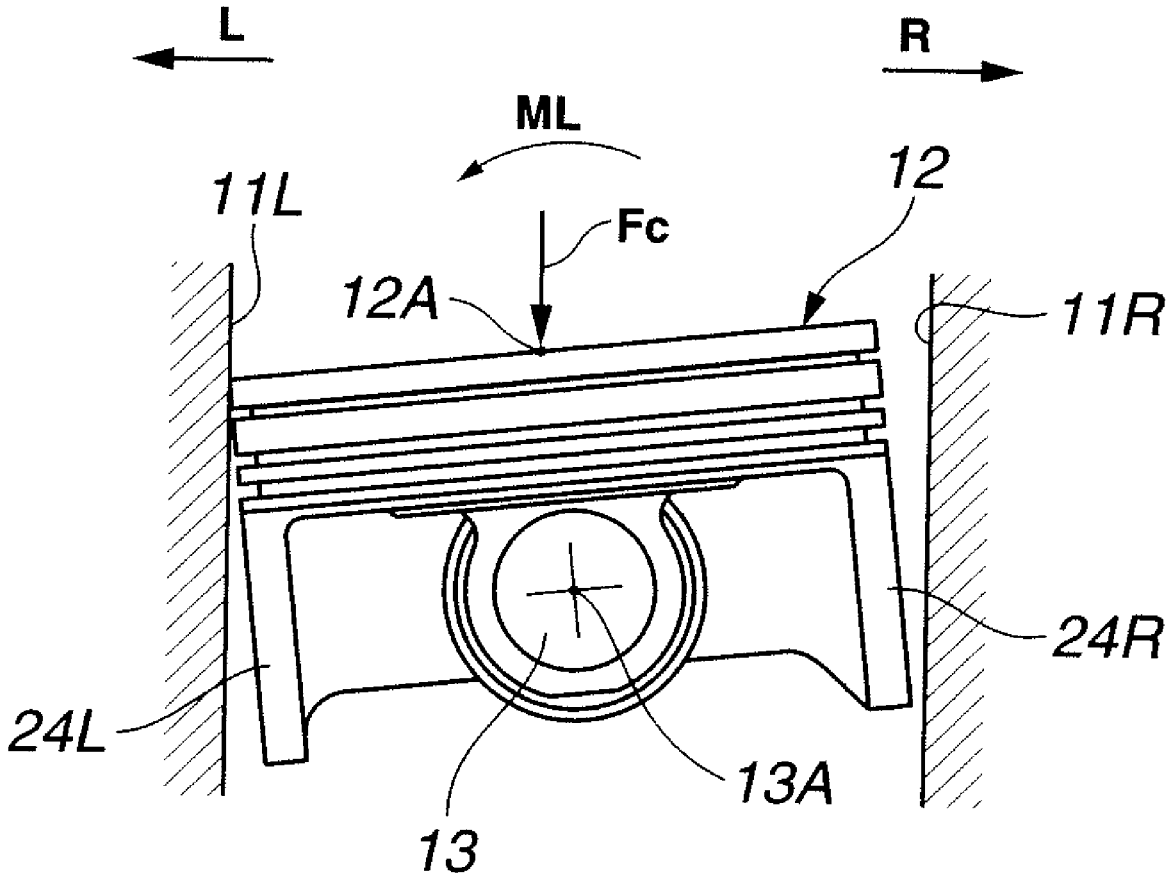
FIG. 6 is a view similar to FIG. 4, but showing a condition wherein the piston is at TDC while being inclined in the direction of "ML".

As is seen from FIGS. 5 and 6, when piston 12 is at or in the vicinity of TDC, upper link 14 is inclined toward the "counter pin offset direction-L" (viz., leftward in the drawing) and a marked combustion pressure "Fc" is substantially applied to piston axis 12A, and thus, as is seen from FIG. 6, due to the inclination of upper link 14, piston 12 is pressed in the counter pin offset section-L and due to the offset positioning of the piston pin axis 13A, a turning moment ML in the "counter pin offset direction-L" (viz., in a counterclockwise direction in FIGS. 5 and 6) is applied to piston 12. With this, as is seen from FIG. 6, an upper portion of piston 12 at "counter pin offset side-L" is strongly pressed against the cylinder wall 11L of cylinder 11. As is known, the upper portion of piston 12 has a high mechanical strength as compared with the lower portion of piston 12. Thus, durability and reliability of piston 12 are not practically affected.

As has been mentioned hereinabove, when upper link 14 reverses its inclination direction (viz., direction of inclination) upon starting its move-down process just after reaching TDC (viz., during a downward movement in a range smaller than 40 degrees in crank angle), the force applied from upper link 14 to piston 12 changes its working direction (viz., thrust and counter thrust directions) thereby causing piston 12 to contact cylinder wall 11R of the "pin offset side-R". In this case, the contact starts from right skirt portion 24R (viz., lower portion) of piston 12 which has a higher flexibility than the upper portion of piston 12, which suppresses or at least minimizes generation of noise and vibration caused by piston 12.

As will be understood from the foregoing description, the multi link type piston-crank mechanism of internal combustion engine according to the present invention comprises an upper link that has an upper end pivotally connected to a piston of the engine through a piston pin, a lower link that is pivotally connected to a lower end of the upper link through an upper pin and rotatably mounted on a crank pin of a crankshaft of the engine, a control link that has one end swingably held by a cylinder block of the engine and the other end pivotally connected to the lower link through a control pin and an above-mentioned unique arrangement. Thus, the multi link type piston-crank mechanism of the present invention is able to exhibit a high freedom of setting piston stroke characteristic as compared with a single link type piston-crank mechanism. That is, by setting the multi link type piston-crank mechanism of the invention to exhibit a piston stroke characteristic much close to that of a simple harmonic motion as compared with the single link type piston-crank mechanism, a marked vibration reduction is achieved in the engine. By providing a mechanism that changes the angular position of the pivot lower end of the control link, the multi link type piston-crank mechanism of the invention can be easily served as a variable compression ratio mechanism.

In the present invention, arrangement of the links and the characteristic of the piston stroke are so made that when the piston takes BDC a part of the piston projects downward beyond the lower edge of the cylinder. With such arrangement and characteristic, increase in height of the cylinder, which would be caused by increase of piston stroke, is suppressed or at least minimized. That is, compact construction of the engine is achieved.

In the vicinity of BDC of piston in the move-down process, a downward inertia force is applied to the piston and at the same time an upward force induced by an in-cylinder negative pressure is also applied to the piston.

As is mentioned hereinabove, in the present invention, the piston pin axis is offset relative to the piston axis in the thrust and counter thrust directions, and when the piston comes to BDC, the offset direction of the piston pin axis relative to the piston axis in the thrust and counter thrust directions changes to a reversed offset direction. That is, in the vicinity of BDC of the piston in the move-down process, the upper link is forced to incline in the counter pin offset direction.

Accordingly, when, with the piston being near BDC, the in-cylinder negative pressure is small and thus a downward inertia force is marked, the piston is pressed toward the counter pin offset direction due to the inclination of the upper link and at the same time a turning moment in the counter pin offset direction is applied to the piston due to the offset placement of the piston pin, so that an upper portion of the piston at the counter pin offset side is strongly pressed against the cylinder wall. While, when, with the piston being near BDC, the in-cylinder negative pressure is high and thus an upward force applied to the piston axis is marked, the piston is pressed toward the pin offset direction due to the inclination of the upper link and at the same time a turning moment in the pin offset direction is applied to the piston due to the offset placement of the piston pin, so that an upper portion of the piston at the pin offset side is strongly pressed against the cylinder wall.

Thus, the posture of the piston is so kept that the thrust load from the cylinder wall is always received by the upper portion of the piston. This means that undesired contact of the piston with the lower edge of the cylinder is suppressed or at least minimized. The upper portion of the piston by which the thrust load is received has a higher rigidity than the lower portion of the piston where skirt portions are formed. Thus, undesired deformation of such skirt portions is suppressed.

Furthermore, in the vicinity of TDC of piston, the upper pin is offset relative to the piston pin axis in the same direction as the offset direction of the piston pin axis. That is, at such position of the piston, the upper link is inclined toward the counter pin offset direction. Thus, when, with the piston being near TDC, a marked downward combustion pressure is applied to the piston (viz., piston axis), the piston is pressed to the cylinder wall at the counter pin offset side due to the inclination of the upper link, and at the same time, a turning moment in the counter pin offset direction is applied to the piston due to the offset placement of the piston pin, so that an upper portion of the piston at the counter pin offset side is strongly pressed against the cylinder wall for receiving the thrust load. That is, for receiving the thrust load originating from the combustion pressure, the stronger upper portion of the piston is practically used.

At a side of the piston where the thrust load is not received, a lower portion of the piston is brought into contact with the cylinder wall. Thus, during downward movement of the piston from TDC, the inclination direction (viz., direction of inclination) of the upper link is reversed and thus the piston is pressed against the opposite cylinder wall due to the reversed inclination of the upper link. However, in this case, the contact of the piston with the cylinder wall starts from the lower portion of the piston that has a higher flexibility than the upper portion of the piston, and thus generation of noise caused by such contact and generation of vibration of the piston are suppressed or at least minimized.

In the above-mentioned embodiment, the respective lower ends of the piston have the same height in the thrust and counter thrust directions. However, if desired, the respective lower ends may have different heights.

The entire contents of Japanese Patent Application 2007-202520 filed Aug. 3, 2007 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A multi link type piston-crank mechanism of an internal combustion engine, comprising:

an upper link that has one end pivotally connected to a piston of the engine through a piston pin;

a lower link that is pivotally connected to the other end of the upper link through an upper pin and rotatably disposed on a crank pin of a crankshaft of the engine; and a control link that has a base end part swingably held by a body of the engine and a leading end pivotally connected to the lower link through a control pin, wherein an axis of the piston pin is offset relative to an axis of the piston in thrust and counter thrust directions, and wherein when the piston comes to BDC (viz., bottom dead center), a part of the piston takes a position below a lower edge of a corresponding cylinder of the engine and the upper pin is offset relative to the axis of the piston pin in the same direction as a pin offset direction in which the axis of the piston pin is offset in the thrust and counter thrust directions relative to the axis of the piston.

2. A multi link type piston-crank mechanism as claimed in claim 1, in which when the piston comes to TDC (viz., top dead center), the upper pin is offset relative to the axis of the piston pin in the same direction as the pin offset direction.

3. A multi link type piston-crank mechanism as claimed in claim 1, in which when the piston comes to BDC, the axis of the piston pin takes a position below the lower edge of the cylinder.

4. A multi link type piston-crank mechanism as claimed in claim 3, in which the following inequality is satisfied in the mechanism:

$$Y \geqq X \cdot \tan\theta \quad (1)$$

wherein:

Y: a degree of offset of the axis of the piston pin relative to the axis of the piston in the thrust and counter thrust directions;

X: a distance from the axis of the piston pin to the lower edge of the cylinder in the direction of an axis of the cylinder at the time when the piston takes BDC; and θ: an inclination angle of the upper link relative to the axis of the cylinder at the time when the piston takes BDC.

5. A multi link type piston-crank mechanism as claimed in claim 1, further comprising a mechanism by which a piston stroke characteristic of the mechanism becomes close to that of a simple harmonic motion as compared with a single link type piston-crank mechanism in which a piston and a corresponding crank pin are connected through a single connecting rod.

6. A multi link type piston-crank mechanism as claimed in claim 1, further comprising an actuating device by which a position of the base end part of the control link is changed for changing the stroke of the piston and thus varying a compression ratio of the engine.

7. A multi link type piston-crank mechanism as claimed in claim 6, in which when a low compression ratio is set by the actuating device, the position of BDC of the piston is lowered as compared with that established when a high compression ratio is set, and at the same time, an inclination angle of the upper link relative to an axis of the cylinder at the time when the piston takes BDC is reduced.

8. A multi link type piston-crank mechanism as claimed in claim 1, further comprising a variable valve mechanism by which a valve lift characteristic of engine valves is varied.

9. A multi link type piston-crank mechanism of an internal combustion engine, comprising:

an upper link that has one end pivotally connected to a piston of the engine through a piston pin;

a lower link that is pivotally connected to the other end of the upper link through an upper pin and rotatably disposed on a crank pin of a crankshaft of the engine;

a control link that has a base end part swingably held by a body of the engine and a leading end pivotally connected to the lower link through a control pin;

means for establishing that an axis of the piston pin is offset relative to an axis of the piston in thrust and counter thrust directions; and means for establishing that when the piston comes to BDC (viz., bottom dead center), a part of the piston takes a position below a lower edge of a corresponding cylinder of the engine and the upper pin is offset relative to the axis of the piston pin in the same direction as a pin offset direction in which the axis of the piston pin is offset in the thrust and counter thrust directions relative to the axis of the piston.

* * * * *